US007470136B2

(12) United States Patent
Yahiro et al.

(10) Patent No.: US 7,470,136 B2
(45) Date of Patent: Dec. 30, 2008

(54) LOCKING DEVICE AND CONNECTOR PROVIDED WITH THE SAME

(75) Inventors: Yasufumi Yahiro, Tokyo (JP); Kentaro Toda, Tokyo (JP); Toshiyuki Moritake, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 11/651,200

(22) Filed: Jan. 9, 2007

(65) Prior Publication Data

US 2007/0202732 A1 Aug. 30, 2007

(30) Foreign Application Priority Data

Feb. 27, 2006 (JP) ..... 2006-050623

(51) Int. Cl.
*H01R 13/62* (2006.01)

(52) U.S. Cl. ..... 439/326

(58) Field of Classification Search ..... 439/326, 439/328, 325

See application file for complete search history.

(56) References Cited

U.S. PATENT DOCUMENTS 6,971,899 B1 * 12/2005 Liu ..... 439/326
7,134,896 B1 * 11/2006 Chen ..... 439/326
7,241,159 B1 * 7/2007 Chen et al. ..... 439/326
7,300,298 B2 * 11/2007 Kameda ..... 439/326

FOREIGN PATENT DOCUMENTS

JP 8-250238 A 9/1996

* cited by examiner

*Primary Examiner*—Neil Abrams
*Assistant Examiner*—Phuong Nguyen
(74) *Attorney, Agent, or Firm*—Frishauf, Holtz, Goodman & Chick, P.C.

(57) ABSTRACT

A locking device which has a strong locking force and is difficult to be broken. Leaf springs bending in a direction toward or away from the rear end of a function expansion card are provided in a housing, and locking sections for locking the function expansion card are connected to the leaf springs. Guide sections are provided in the housing, for guiding the outer ends of the leaf springs in the direction of bending of the leaf springs.

25 Claims, 10 Drawing Sheets

LOCKING DEVICE AND CONNECTOR PROVIDED WITH THE SAME

BACKGROUND OF THE INVENTION

1. Field of the Invention

This invention relates to a locking device for a card-type electronic device, and a connector device for a card-type electronic device, provided with the locking device.

2. Prior Art

Conventionally, there has been proposed an edge connector provided with a housing, lower contacts, upper contacts, and locking mechanisms (see Japanese Laid-Open Patent Publication (Kokai) No. H08-250238 (Paragraph numbers [0011] to [0017], and [0020], and FIG. 1).

The housing is comprised of a body extending in the left-right direction, and arm sections extending backward from the left and right ends of the body. The body is formed with a circuit board-receiving groove. In a lower surface of an upper wall of the circuit board-receiving groove, upper contact-receiving grooves extending in the front-rear direction are formed along the left-right direction at equal space intervals.

The circuit board-receiving groove has a contact-arranging surface formed at a lower portion thereof. In the contact-arranging surface, lower contact-receiving grooves extending in the front-rear direction are formed along the left-right direction at equal space intervals.

The lower contacts are held within the respective lower contact-receiving grooves. The rear ends of the lower contacts reach the inside of the circuit board-receiving groove.

The upper contacts are held within the respective upper contact-receiving grooves. The rear ends of the upper contacts are located forward with respect to the rear ends of the lower contacts.

The locking mechanisms are each comprised of a release lever configured to open in the left-right direction with respect to the arm section, and a locking section configured to open in the left-right direction in unison with the release lever. The locking section is generally hook-shaped.

To connect a memory module, which is a card-type electronic device, to the connector, first, one end of the memory module is inserted into the connector at a predetermined insertion angle. At this time, pads formed on the upper and lower surfaces of the one end of the memory module are disposed between the lower contacts and the upper contacts.

Then, the memory module is pivotally moved about the one end thereof such that the insertion angle is made smaller. At this time, the one end of the memory module urges the lower contacts and the upper contacts such that the distance between the lower contacts and the upper contacts is widened. Further, the locking section of the locking mechanisms are pressed by associated side surfaces of the memory module, whereby the release levers are bent in directions away from the memory module.

After that, when the memory module is pivotally moved until the insertion angle becomes approximately equal to 0°, the lower contacts and the upper contacts caused to undergo elastic deformation by the one end of the memory module are brought into pressure contact with the pads formed on the upper and lower surfaces of the one end of the memory module, to be electrically connected thereto, respectively. Further, when the memory module is pivotally moved until the insertion angle becomes approximately equal to 0°, the side surfaces of the memory module pass the associated locking sections, and the locking sections are returned to their original positions for engagement with the upper surface of the memory module. As a consequence, the pivotal motion of the memory module in a direction of increasing the insertion angle is blocked, whereby the memory module is held in the state electrically connected to the connector.

To release the locked state of the memory module, first, the release levers are pushed in the direction away from the memory module to thereby remove the locking sections from the upper surface of the memory module.

Then, the memory module is pivotally moved through the predetermined insertion angle. At this time, the memory module is pivotally moved by the spring forces of the lower contacts and the upper contacts.

Finally, when the memory module is pivotally moved through the predetermined insertion angle, it is only required to draw out the memory module from the connector.

In the above-described connector, the memory module is locked by locking the upper surface of the memory module by the generally hook-shaped locking sections, and therefore when the memory module is attempted to be pivotally moved by a wrong operation without unlocking the same, or when an external force for pivotally moving the memory module is applied to the memory module, there are possibilities of the memory module being unlocked and the locking mechanism being broken.

SUMMARY OF THE INVENTION

The present invention has been made in view of these circumstances, and an object thereof is to provide a locking device which has a strong locking force and is difficult to be broken, and a connector device including the same.

To attain the above object, in a first aspect of the present invention, there is provided a locking device for holding a card-type electronic device when one end of the card-type electronic device is fitted to a connector fixed to a surface of a circuit board, comprising a housing fixed to the surface of the circuit board, a spring section disposed in the housing, for being fitted to the card-type electronic device to thereby apply an urging force thereof to the card-type electronic device, a locking section provided on the spring section, for being engaged with the other end of the card-type electronic device fitted to the connector to thereby prevent the other end of the card-type electronic device from being lifted, and a guide section provided in the housing, for guiding part of the spring section in a predetermined direction.

With the arrangement of the locking device according to the first aspect of the present invention, the guide section for guiding part of the spring section in the predetermined direction is provided, and hence when a strong force for unlocking the card-type electronic device is applied to the locking section, the force is dispersed in the housing via the guide section. Therefore, the locking device has a strong locking force and is difficult to be broken.

Preferably, the spring section, the locking section, and the guide section are integrally formed with each other by blanking and bending a piece of metal sheet.

Preferably, the housing has a positioning portion having a first positioning pin for positioning the other end of the card-type electronic device.

More preferably, the positioning portion has at least one second positioning pin for positioning the housing with respect to the circuit board.

Further preferably, there are provided a plurality of the second positioning pins, and the second positioning pins are formed to have respective shapes different from each other.

More preferably, the housing has a guide wall having a first guide surface for guiding the other end of the card-type electronic device to the positioning portion, and a second guide surface for guiding the other end of the card-type electronic device to the first guide surface.

More preferably, the locking section comprises an engaging portion that is pushed away by the other end of the card-type electronic device when the one end of the card-type electronic device is being fitted to the connector, and a locking portion that locks the other end of the card-type electronic device when the one end of the card-type electronic device has been fitted to the connector, the engaging portion having a sloping surface that guides the other end of the card-type electronic device, the locking portion having a surface opposed to the circuit board and a surface opposed to the connector.

Further preferably, the sloping surface is substantially parallel to the second guide surface and is located closer to the circuit board than the second guide surface, and the surface opposed to the connector is in flush with the guide surface when the other end of the of the card-type electronic device is locked by the locking portion.

To attain the above object, in a second aspect of the present invention, there is provided a connector device including the locking device according to any of the first aspect of the present invention and preferred embodiments thereof described above.

With the arrangement of the connector device according to the second aspect of the present invention, the connector device is locked with a strong locking force and the locking device thereof is difficult to be broken.

The above and other objects, features and advantages of the present invention will become more apparent from the following detailed description taken in conjunction with the accompanying drawings.

DETAILED DESCRIPTION OF THE PREFERRED EMBODIMENT

Hereinafter, a preferred embodiment of the present invention will be described in detail with reference to the drawings.

Figure 1:
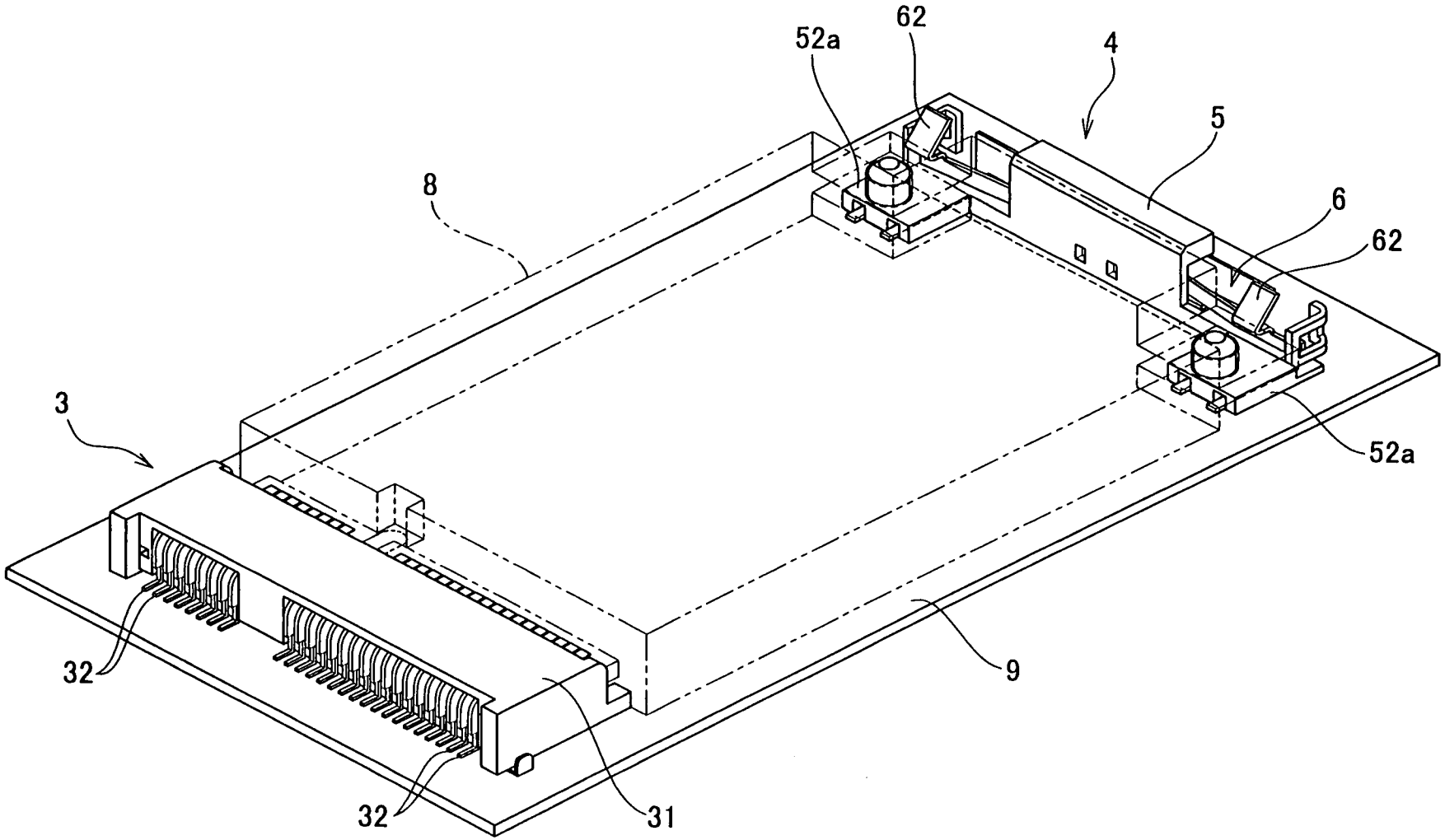
FIG. 1 is a perspective view of a connector device for a card-type electronic device, including a locking device according to an embodiment of the present invention.
Figure 2:
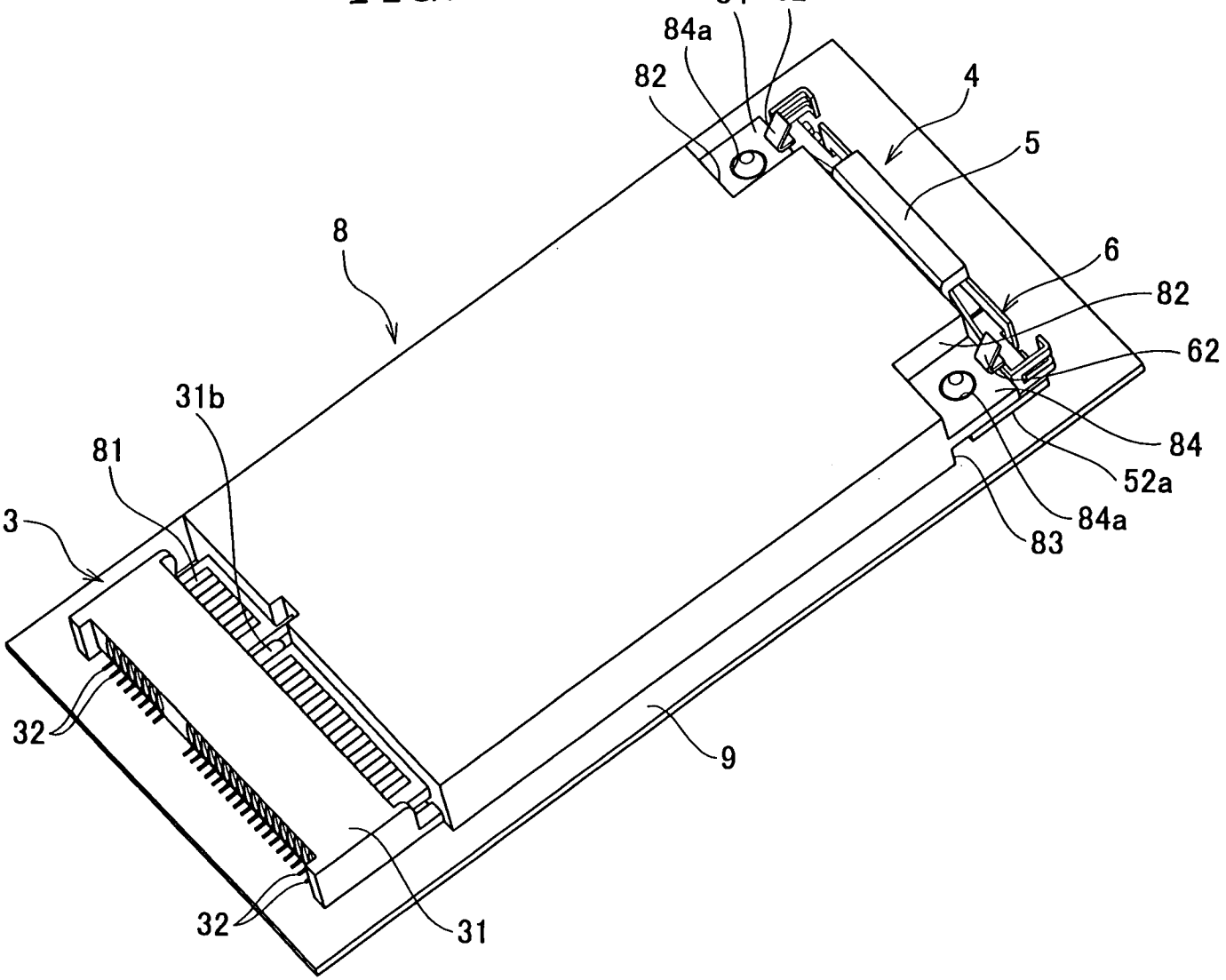
FIG. 2 is a perspective view of the connector device in a state in which a function expansion card is connected thereto.

FIG. 1 is a perspective view of a connector device including a locking device according to an embodiment of the present invention. FIG. 2 is a perspective view of the connector device in a state in which a function expansion card is connected thereto.

Referring to FIG. 1, the connector device is for a function expansion card (card-type electronic device) 8, and is mounted on a printed wiring board (circuit board) 9. The connector is comprised of a connector body (connector) 3 and the locking device 4. The function expansion card 8 has a front end (one end) provided with a connecting portion 81. A rear end (the other end) of the function expansion card 8 has recesses 82 and 83 formed in respective upper and lower surfaces of each of opposite corners thereof. The recesses 82 and 83 are in a front-back relationship with respective thin portions 84 therebetween. Each recess 82 receives a locking section 62, described hereinafter, and each recess 83 receives a plate-like portion 52*a*, described hereinafter. Each thin portion 84 is formed with a positioning hole 84*a*.

The connector body 3 is comprised of a housing 31, a plurality of upper contacts 32, and a plurality of lower contacts (not shown).

The housing 31 includes a receiving hole 31*a* (see FIG. 8) for receiving the connecting portion 81 of the function expansion card 8. The housing 31 is provided with a key 31*b* for preventing wrong fitting.

The upper contacts 32, and the lower contacts (not shown) are held by the housing 31 at equal space intervals. Contact portions (not shown) of the upper contacts 32 and contact portions (not shown) of the lower contacts are opposed to each other via the receiving hole 31*a*.

Figure 3:
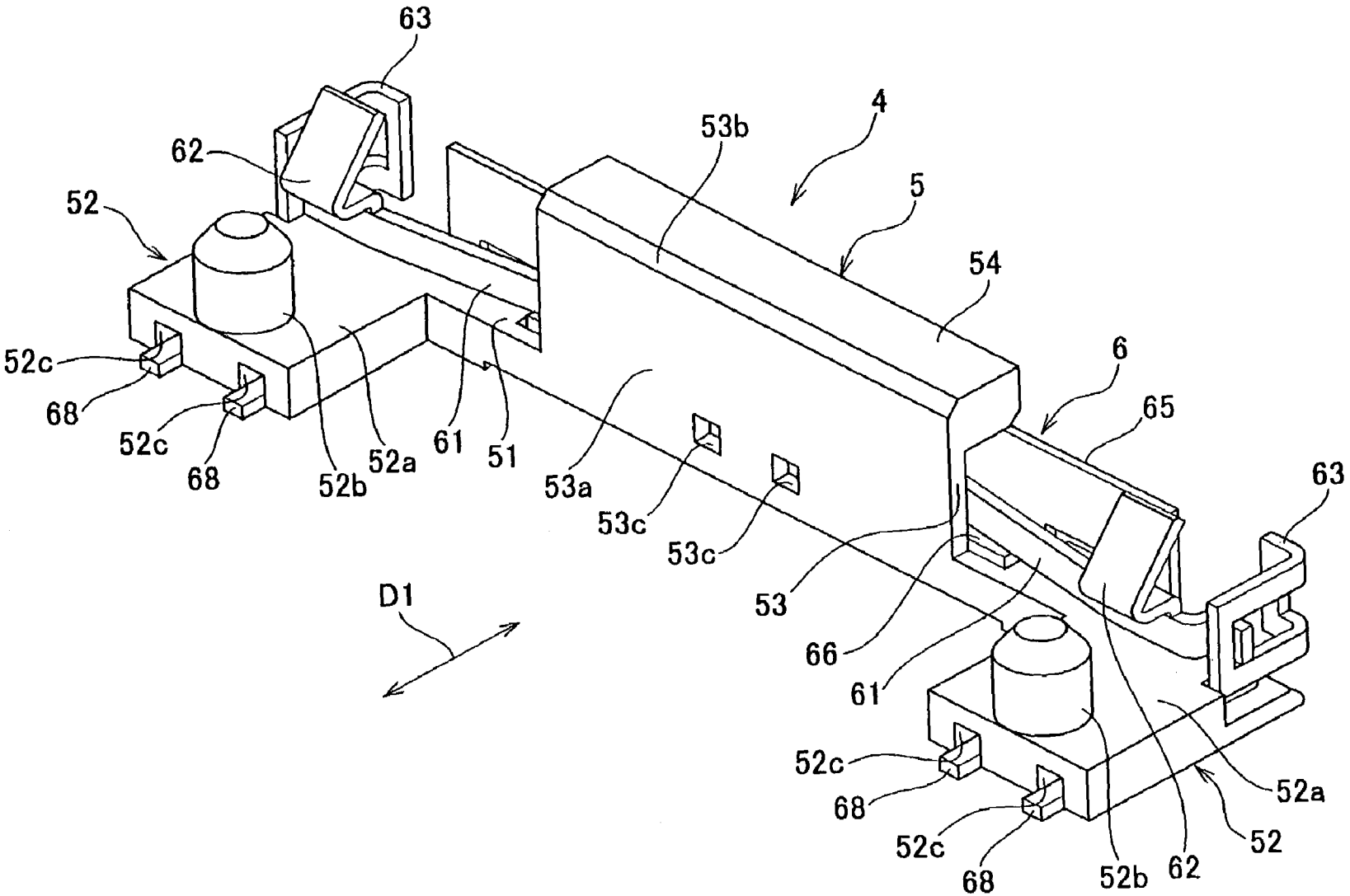
FIG. 3 is a perspective view of the locking device of the connector shown in FIG. 1.
Figure 4:
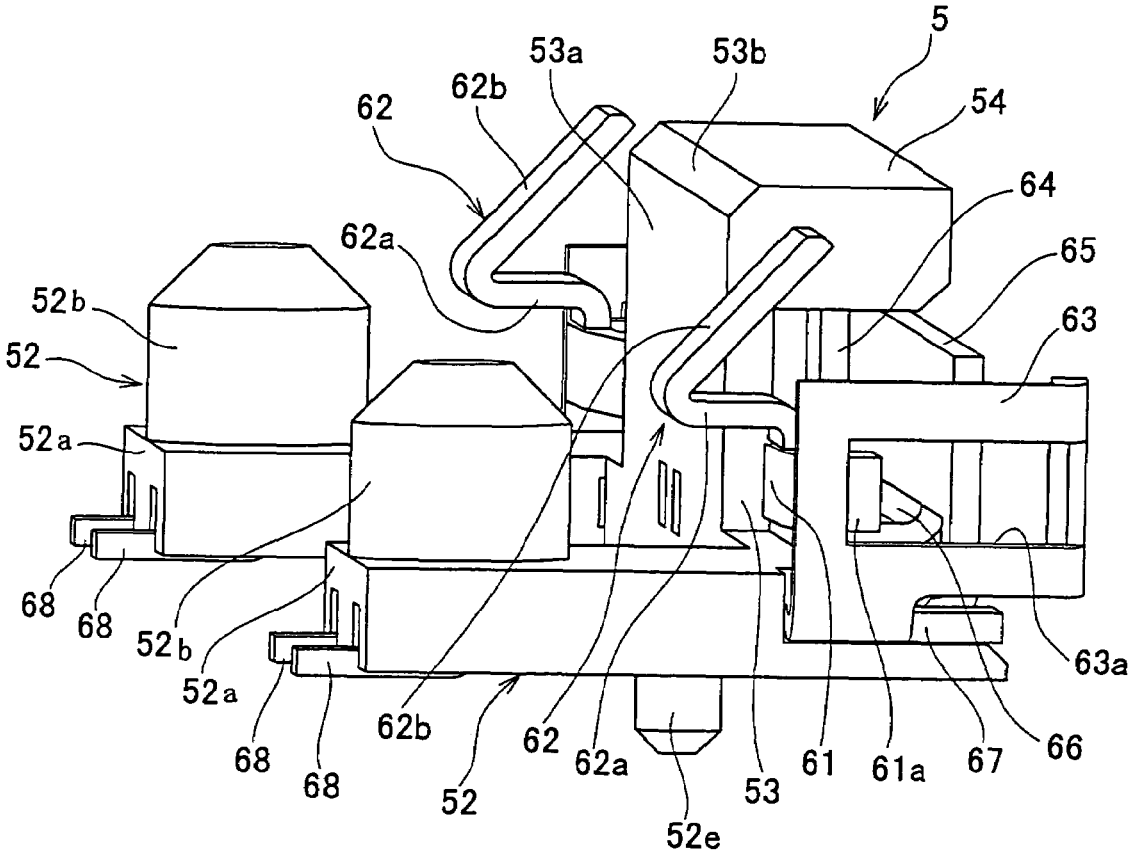
FIG. 4 is a perspective view of the locking device, as viewed from another direction.
Figure 5:
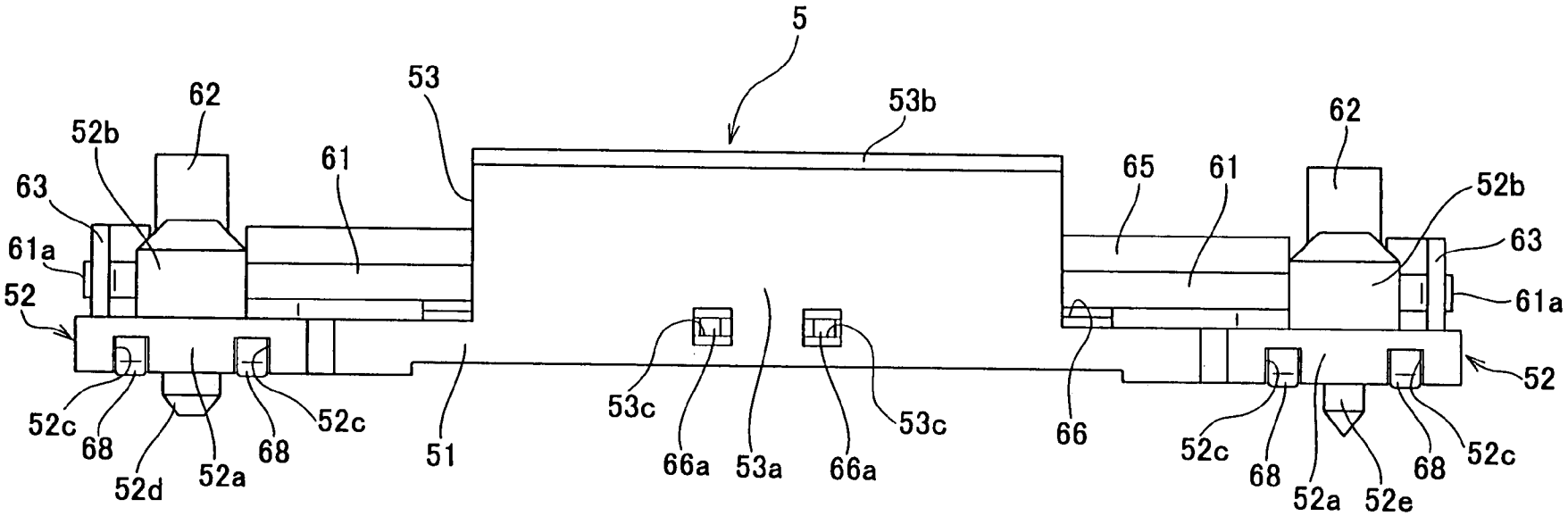
FIG. 5 is a front view of the locking device.
Figure 6:
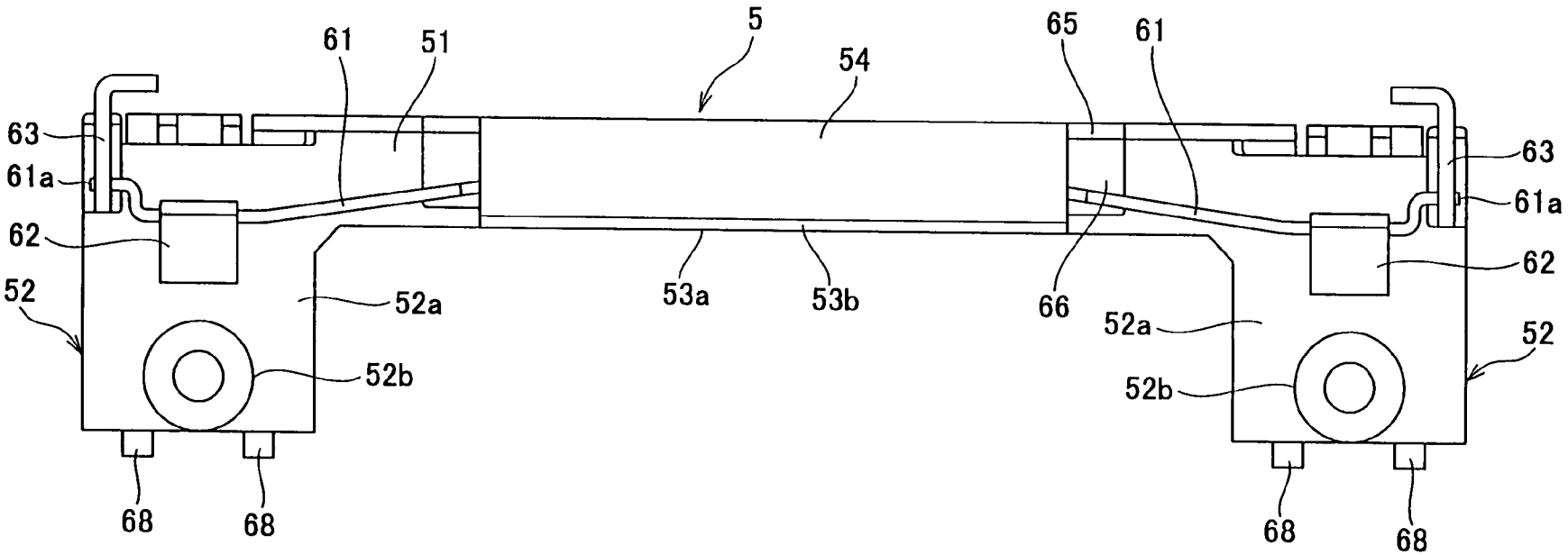
FIG. 6 is a plan view of the locking device.
Figure 7:
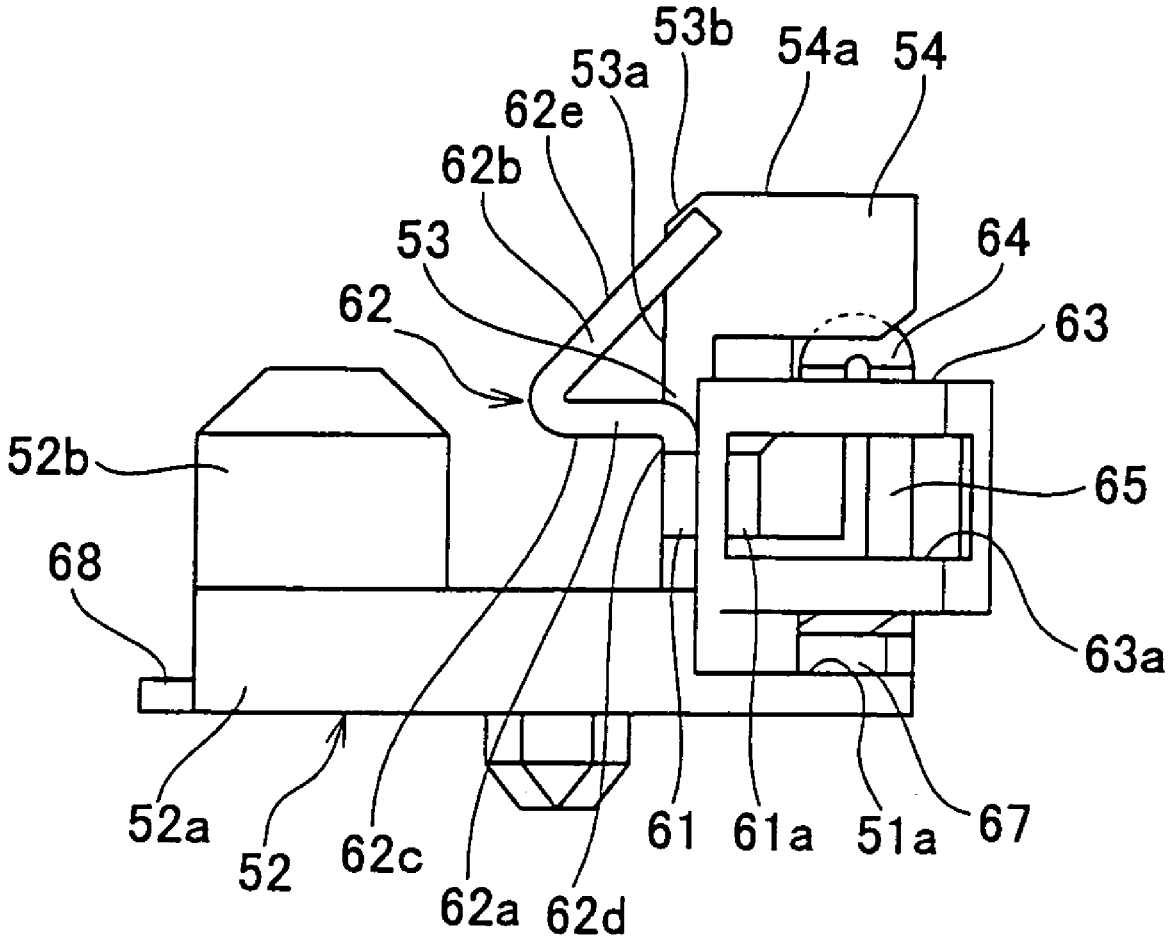
FIG. 7 is a side view of the locking device.

FIG. 3 is a perspective view of the locking device of the connector for the card-type electronic device, shown in FIG. 1. FIG. 4 is a perspective view of the locking device, as viewed from another direction. FIG. 5 is a front view of the locking device. FIG. 6 is a plan view of the locking device. FIG. 7 is a side view of the locking device.

As shown in FIGS. 3 to 7, the locking device 4 is comprised of a housing 5 and a locking member 6.

The housing 5 includes a base 51, a pair of positioning portions 52, a guide wall 53, and a ceiling 54, which are integrally formed of resin.

The base 51 has a plate-like shape. The base 51 has grooves 51*a* formed in rear surfaces of opposite ends thereof (see FIG. 7).

The positioning portions 52 each have a plate-like portion 52*a* and a positioning pin (first positioning pin) 52*b*. The plate-like portion 52*a* is formed on each of respective front surfaces of the opposite ends of the base 51. A groove 52*c* is formed in a lower surface of the plate-like portion 52*a*. The groove 52*c* extends along a front-rear direction D1. The positioning pin 52*b* is provided for positioning the function expansion card 8. It is disposed on an upper surface of the plate-like portion 52*a*, and is inserted into the positioning hole 84*a* of the thin portion 84 of the function expansion card 8 (see FIG. 2).

A positioning pin (second positioning pin) 52*d* is provided on the lower surface of one of the pair of plate-like portions 52*a*, and a positioning pin (second positioning pin) 52*e* is provided on the lower surface of the other plate-like portion 52*a*. The positioning pins 52*d* and 52*e* are provided for positioning the locking device 4 with respect to the printed wiring board 9. The thickness of the positioning pin 52*d* and that of the positioning pin 52*e* are different from each other so as to prevent wrong insertion of these pins into holes (not shown) of the printed wiring board 9.

The guide wall 53 is formed on a front edge of an upper surface of the base 51 such that it extends perpendicular to the base 51. The front surface of the guide wall 53 forms a guide surface (first guide surface) 53*a* for guiding the rear end of the function expansion card 8 to the positioning portions 52. An upper end of the guide wall 53 is chamfered, and the chamfered portion forms a guide surface (second guide surface) 53*b* for guiding the rear end of the function expansion card 8 to the guide surface 53*a*. In a lower portion of the center of the guide wall 53, there are formed two positioning holes 53*c*.

The locking member 6 has a pair of leaf springs (spring sections) 61, a pair of locking sections 62, and a pair of guide sections 63. These components 61, 62, and 63 are integrally formed with a connecting portion 64, a rear plate 65, a leg portion 66, inserted portions 67, ground terminals 68, and holddowns 69, described hereinafter, by blanking and bending a piece of resilient and electrically conductive metal sheet.

The leaf springs 61 are capable of bending in a direction toward or away from the rear end of the function expansion card 8 connected to the connector body 3. An outer end 61 of each leaf spring 61 is bent into a crank shape.

The pair of leaf springs 61 are connected to the rear plate 65 by the connecting portion 64 (see FIG. 7) bent into a substantially inverted-U shape. The leg portion 66 is connected to a lower end of the rear plate 65. The rear plate 65 is erected on the base 51 at right angles thereto by the leg portion 66. Protrusions 66*a* are formed on a central portion of the leg portion 66. The protrusions 66*a* are inserted into the positioning holes 53*c*. Thus, the locking member 6 is positioned with respect to the housing 5.

The inserted portions 67 (see FIG. 7) are connected to opposite ends of the rear plate 65, respectively. The inserted portions 67 are inserted into the grooves 51*a* of the base 51. Thus, the locking member 6 is rigidly fixed to the base 51.

The locking sections 62 are connected to respective portions of the leaf springs 61 close to the outer ends 61*a* thereof. The locking sections 62 also serve as ground contacts. The locking sections 62 each have a locking portion 62*a* and an engaging portion 62*b* (see FIG. 7). The locking portion 62*a* is bent at right angles, and has a horizontal surface (surface opposed to the circuit board) 62*c* and a vertical surface (surface opposed to the connector) 62*d*. The horizontal surface 62*c* and the vertical surface 62*d* are brought into intimate contact with a ground pad (not shown) formed at each corner of the thin portions 84 of the function expansion card 8. Further, the vertical surface 62*d* is configured such that it is flush with the guide surface 53*a* along the same plane (not shown), when the function expansion card 8 is locked. The engaging portion 62*b* is connected to an end of the locking portion 62*a*. As shown in FIG. 7, the engaging portion 62*b* has a sloping surface 62*e*. The sloping surface 62*e* is substantially parallel to an imaginary surface (not shown) with which the guide surface 53*b* of the guide wall 53 is to be brought into surface contact, and is located below the imaginary surface. Further, an upper end of the sloping surface 62*e* is located backward (i.e. in a direction away from the connector body 3) of the guide surface 53*a* of the guide wall 53, and at the same time is below a ceiling surface 54*a* of the ceiling 54.

The guide sections 63 are connected to the inserted portions 67. The guide sections 63 extend substantially along a direction of bending of the leaf springs 61. Each guide section 63 is formed with a guide hole 63*a*. The guide hole 63*a* receives the outer end 61*a* of the leaf spring 61. Thus, when the leaf springs 61 bend and return to an original state thereof, the guide sections 63 guide the outer ends 61*a* in a direction (predetermined direction) parallel to the direction of bending of the leaf springs 61.

To the inserted portions 67 are connected the ground terminals 68, respectively. The ground terminals 68 are electrically connected to the locking sections 62. The ground terminals 68 are received in the grooves 52*c* of the plate-like portions 52*a*, respectively, except for foremost ends thereof. The foremost ends of the ground terminals 68 protrude from the associated grooves 52*c*.

The holddowns 69 (see FIG. 9) are connected to the inserted portions 67, respectively. The holddowns 69 are fixed to the printed wiring board 9, whereby the locking device 4 is fixed to the printed wiring board 9.

Figure 8A:
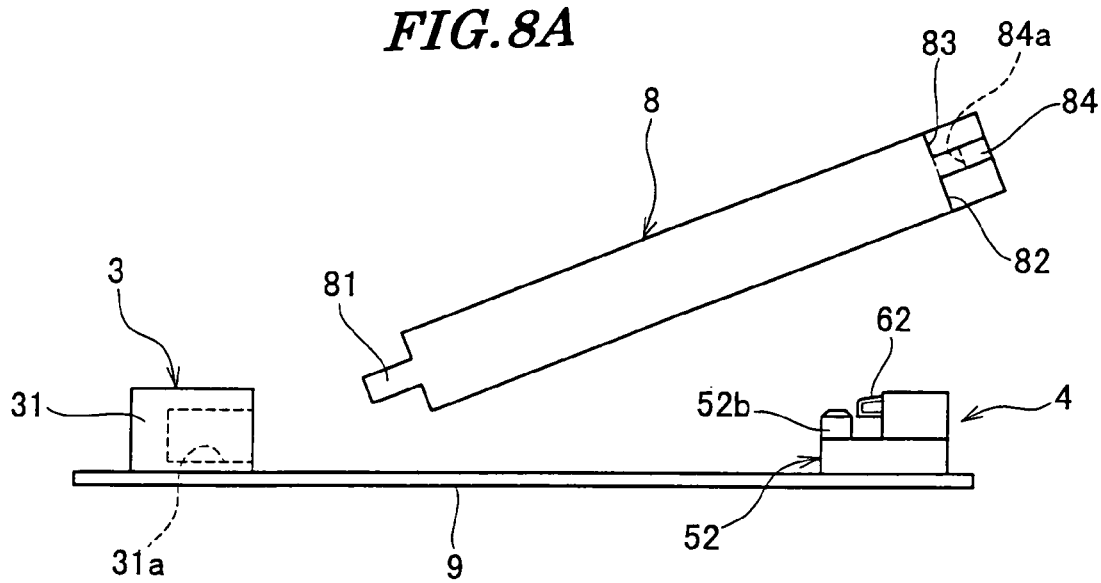
FIG. 8A is a conceptual view of the connector device in a state in which the function expansion card has not been inserted into a connector body yet.
Figure 8B:
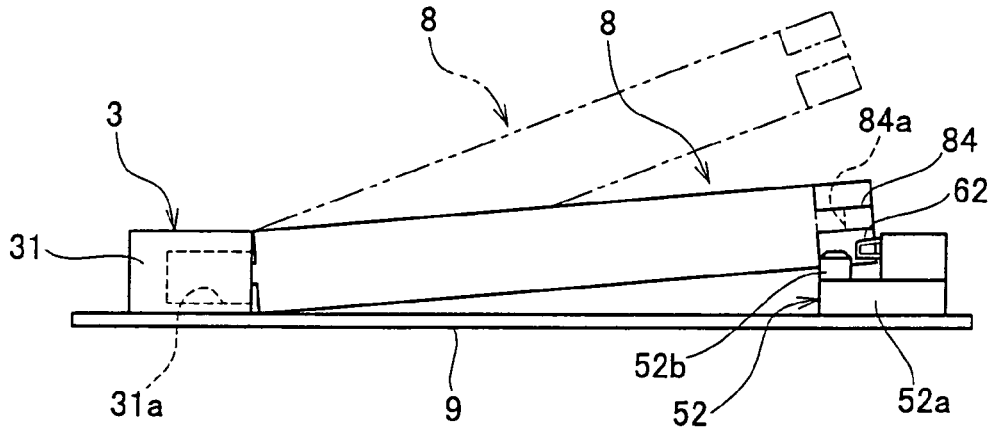
FIG. 8B is a conceptual view of the connector device in a state in which the function expansion card is being inserted into the connector body.
Figure 8C:
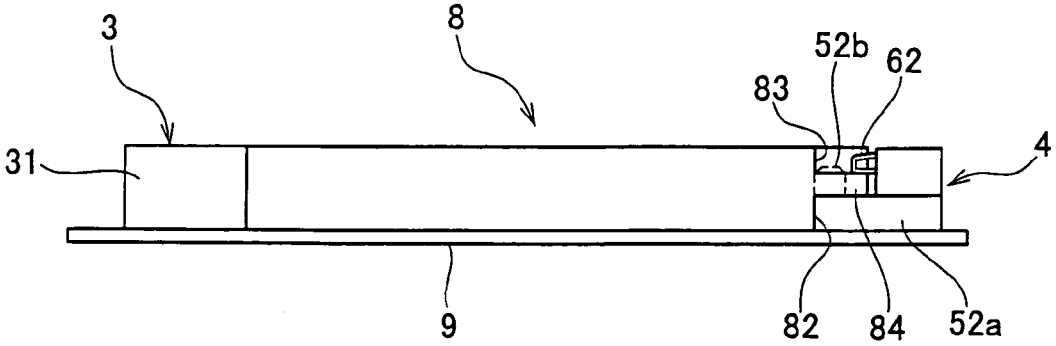
FIG. 8C is a conceptual view of the connector device in a state in which the function expansion card has been completely fitted to the connector body.
Figure 9:
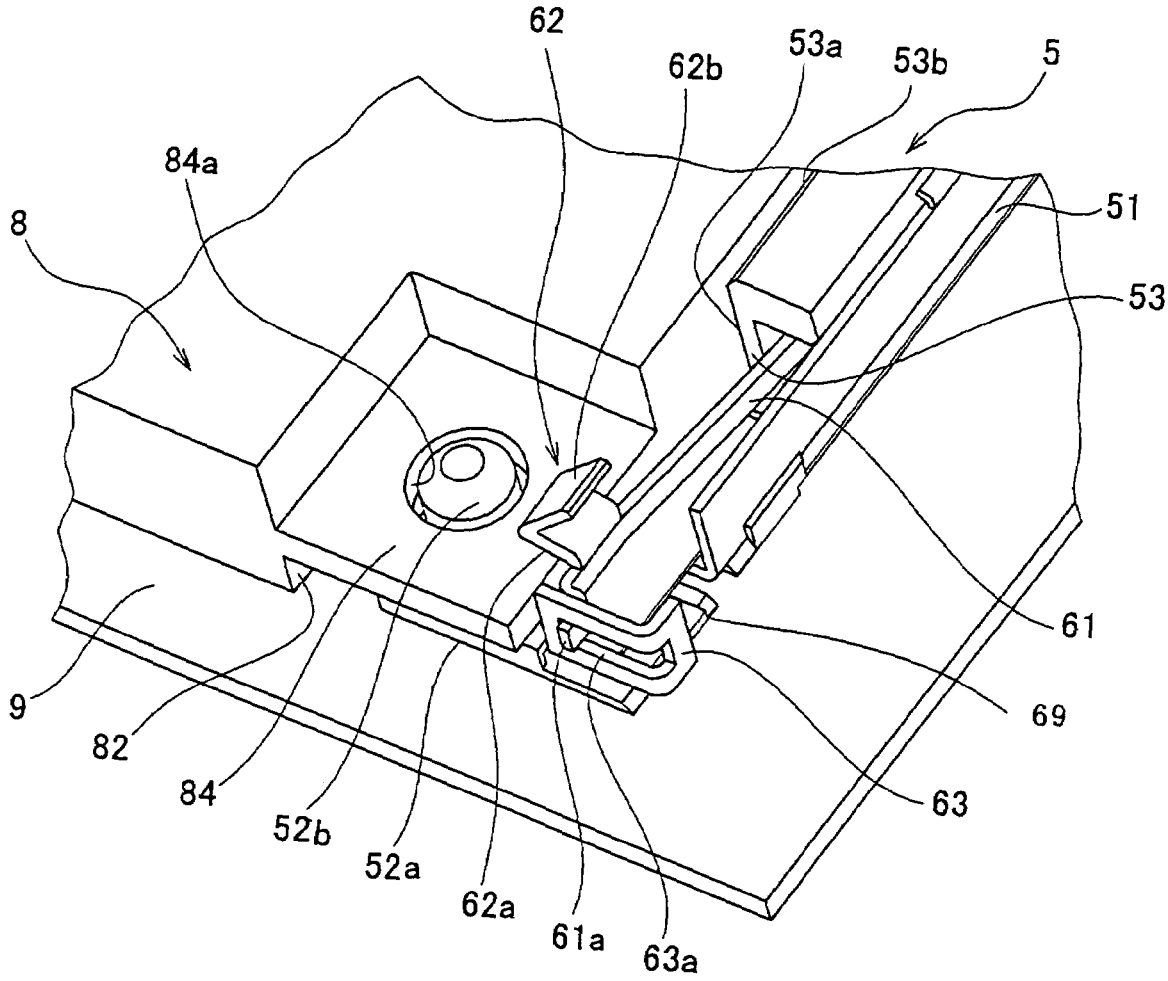
FIG. 9 is a perspective view of the connector device in the state in which the function expansion card has been completely fitted to the connector body, as viewed from obliquely above.
Figure 10:
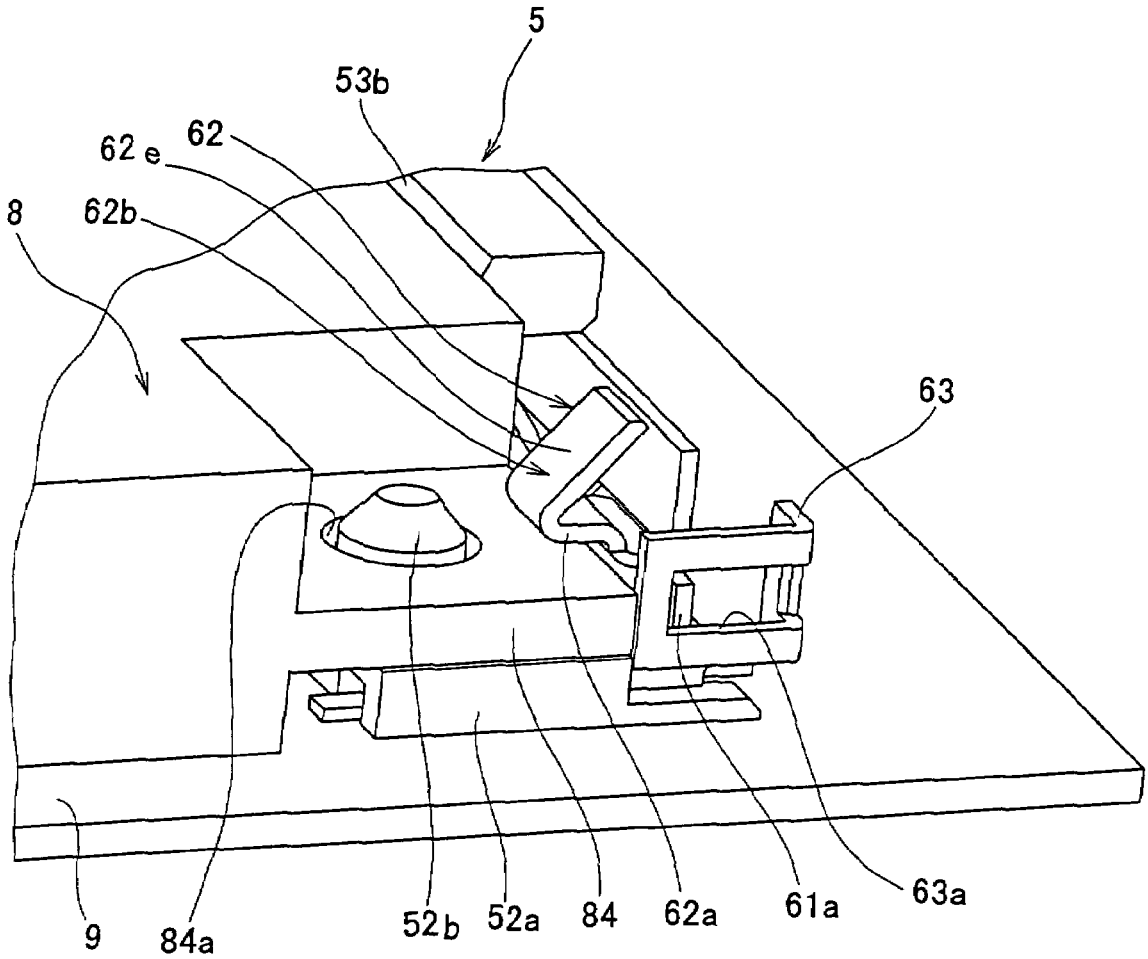
FIG. 10 is a perspective view of the connector device in the state in which the function expansion card has been completely fitted to the connector body, as viewed from another direction.

FIG. 8A is a conceptual view of the connector device in a state in which the function expansion card has not been inserted into the connector body yet. FIG. 8B is a conceptual view of the connector device in a state in which the function expansion card is being inserted into the connector body. FIG. 8C is a conceptual view of the connector device in a state in which the function expansion card has been completely fitted to the connector body. FIG. 9 is a perspective view of the connector device in the state in which the function expansion card has been completely fitted to the connector body, as viewed from obliquely above. FIG. 10 is a perspective view of the connector device in the state in which the function expansion card has been completely fitted to the connector body, as viewed from another direction.

Next, an operation for connecting the function expansion card 8 to the connector for the card-type electronic device with reference to FIGS. 8 to 10.

Referring first to FIGS. 8A and 8B, the connecting portion 81 of the function expansion card 8 is inserted into the receiving hole 31*a* of the connector body 3 at a predetermined insertion angle.

Then, the function expansion card 8 is rotated such the insertion angle is made smaller, as shown by two-dot chain lines and solid lines in FIG. 8B.

When the function expansion card 8 is pivotally moved, first, the rear end of the function expansion card 8 is brought into contact with the guide surface 53*b* of the guide wall 53, and guided to the guide surface 53*a* thereof. After that, the thin portions 84 of the function expansion card 8 are brought into contact with the associated engaging portions 62*b* of the locking sections 62, and slides down along the sloping surfaces 62*e* of the engaging portions 62*b*. At this time, the engaging portions 62*b* are pressed backward (i.e. in the direction away from the connector body 3), for being moved away from a track along which the function expansion card 8 is moved, and along with the motion of the engaging portions 62*b*, the leaf springs 61 are bent backward.

Then, the thin portions 84 passes the engaging portions 62*b*, whereby the thin portions 84 and the associated engaging portions 62*b* are disengaged from each other. At this time, the spring forces of the leaf springs 61 are released to return the locking sections 62 to their original positions. As a result, the locking portions 62*a* of the locking sections 62 are brought into intimate contact with associated upper surfaces of the thin portions 84, whereby the function expansion card 8 is locked by the locking sections 62. At this time, the horizontal surface 62*c* and the vertical surface 62*d* (see FIG. 7) of each locking portion 62*a* are brought into intimate contact with the ground pad formed at each corner of the thin portions 84.

To unlock the function expansion card 8, it is only required to move the outer ends 61*a* of the leaf springs 61 backward to thereby release the engaged states of the locking portions 62*a* and the associated thin portions 84.

When a person who handles the function expansion card 8 lifts the rear end of the function expansion card 8 without unlocking the same, or when the rear end of the function expansion card 8 is lifted by some external force, the force for lifting the rear end of the function expansion card 8 is dispersed in the base 51 via the outer ends 61*a* of the leaf springs 61 and the guide sections 63, so that there is little fear of the locking device 4 being broken.

Further, as described above, since the locking section 62 is configured such that the force applied to the locking section 62 is dispersed e.g. into the base, there is little fear of the function expansion card 8 being unlocked by mistake.

Furthermore, the horizontal surface 62*c* and the vertical surface 62*d* of the locking portion 62*a* of each locking section 62 are configured such that they are brought into intimate contact with the ground pad formed at each corner of the thin portions 84. This reduces contact resistance of the function expansion card 8 with the ground pads, which results in excellent electric characteristics.

Further, since the positional relationship of the sloping surfaces 62*e* relative to the guide surface 53*a*, the guide surface 53*b*, and the ceiling surface 54*a* is set as described above, when the function expansion card 8 is locked, the function expansion card 8 is brought into contact with the sloping surfaces 62*e* of the locking sections 62 after being brought into contact with the guide surface 53*b* and the guide surface 53*a*. Therefore, there is little fear of the locking member 6 being broken by the function expansion card 8 during the operation for locking the function expansion card 8.

Furthermore, when the function expansion card 8 is attempted to be locked in a state in which the connecting portion 81 of the function expansion card 8 is not sufficiently inserted into the receiving hole 31*a*, since the rear end of the function expansion card 8 abuts against the guide surface 53*b*, it is impossible to cause the function expansion card 8 to be further pushed in. As a consequence, it is possible to prevent insufficient fitting of the function expansion card 8 to the connector. In this case, since the thin portions 84 of the function expansion card 8 do not abut against the sloping surfaces 62*e* but abut against the guide surface 56, it is possible to prevent the locking sections 62 from being broken.

Further, when the function expansion card 8 is locked, even if an external force for moving the function expansion card 8 backward is applied to the card 8, the external force is received by the guide surface 53*a*, and hardly acts on the vertical surfaces 62*d*, since the vertical surfaces 62*d* of the locking sections 62 are in flush with the guide surface 53*a*. As a result, there is little fear of the locking member 6 being broken by the external force for moving the function expansion card 8 backward.

It should be noted that although the connector device according to the above-described embodiment is for the function expansion card 8, this is not limitative, but the present invention can also be applied to a connector e.g. for a circuit board.

Further, although in the present embodiment, the locking member 6 is formed of a piece of metal sheet, the locking member 6 is not necessarily required to be constructed as such, but it may be formed using a plurality pieces of metal sheet.

It should be noted that although in the present embodiment, there are provided a pair of leaf springs 61, a pair of locking sections 62, and a pair of guide sections 63, they are not required to be provided in pairs, but the numbers of them may be one or three or more.

Further, although in the present embodiment, the outer ends 61*a* of the leaf springs 61 are configured to be guided by the guide sections 63 in the predetermined direction, portions of the leaf springs 61 other than the outer ends 61*a* may be guided by the guide sections 63 in the predetermined direction.

Further, the arrangement relationship between the leaf springs 61, the locking sections 62, the guide sections 63, and so forth are by no means limited to the relationship defined in the present embodiment, but the leaf springs 61 may be arranged in a manner opposed to side surfaces of the function expansion card 8, by way of example.

Further, although in the present embodiment, the connector body 3 and the locking device 4 are formed separately from each other, they may be formed as a unitary member.

It is further understood by those skilled in the art that the foregoing is the preferred embodiment of the present invention, and that various changes and modification may be made thereto without departing from the spirit and scope thereof.

What is claimed is:

1. A locking device for holding a card-type electronic device when a first end of the card-type electronic device is fitted to a connector that is fixed to a surface of a circuit board, comprising:

a housing fixed to the surface of the circuit board;

a spring section which is disposed in said housing, and which elastically deforms toward or away from the card-type electronic device along a predetermined direction;

a locking section provided on said spring section, for engaging with a second end of the card-type electronic device fitted to the connector by a spring force of the spring section so as to prevent the second end of the card-type electronic device from being lifted; and a guide section provided in said housing, for guiding a part of said spring section in the predetermined direction and for preventing movement of part of the spring section in a lifting direction of the second end of the card-type electronic device.

2. A connector device including the locking device as claimed in claim 1.

3. A locking device as claimed in claim 1, wherein said housing comprises at least one positioning pin for positioning said housing with respect to the circuit board.

4. A locking device as claimed in claim 3, wherein said housing comprises a plurality of said positioning pins, and said positioning pins have respective shapes which are different from each other.

5. A locking device as claimed in claim 4, wherein said housing comprises a plurality of said positioning pins, and said positioning pins have respective shapes which are different from each other.

6. A locking device as claimed in claim 1, wherein said housing comprises a first positioning pin for positioning the second end of the card-type electronic device.

7. A connector device including the locking device as claimed in claim 6.

8. A locking device as claimed in claim 6, wherein said housing comprises at least one second positioning pin for positioning said housing with respect to the circuit board.

9. A locking device as claimed in claim 8, wherein said housing comprises a plurality of said second positioning pins, and said second positioning pins have respective shapes which are different from each other.

10. A connector device including the locking device as claimed in claim 8.

11. A locking device as claimed in claim 6, wherein said housing comprises a guide wall having a first guide surface for guiding the second end of the card-type electronic device to said first positioning pin, and a second guide surface for guiding the second end of the card-type electronic device to said first guide surface.

12. A locking device as claimed in claim 11, wherein said locking section comprises:

an engaging portion that is pushed away from the card-type electronic device by the second end of the card-type electronic device when the first end of the card-type electronic device is being fitted to the connector; and a locking portion that locks the second end of the card-type electronic device when the first end of the card-type electronic device has been fitted to the connector, wherein said engaging portion has a sloping surface that guides the second end of the card-type electronic device, and wherein said locking portion has a surface opposed to the circuit board and a surface opposed to the connector.

13. A locking device as claimed in claim 12, wherein the sloping surface is substantially parallel to said second guide surface and is located closer to the circuit board than said second guide surface, and the surface opposed to the connector is flush with the first guide surface when the second end of the of the card-type electronic device is locked by said locking portion.

14. A locking device as claimed in claim 1, wherein said spring section, said locking section, and said guide section are integrally formed with each other by blanking and bending a piece of metal sheet.

15. A connector device including the locking device as claimed in claim 14.

16. A locking device as claimed in claim 14, wherein said housing comprises at least one positioning pin for positioning said housing with respect to the circuit board.

17. A locking device as claimed in claim 14, wherein said housing comprises a first positioning pin for positioning the second end of the card-type electronic device.

18. A connector device including the locking device as claimed in claim 17.

19. A locking device as claimed in claim 17, wherein said housing comprises a guide wall having a first guide surface for guiding the second end of the card-type electronic device to said first positioning pin, and a second guide surface for guiding the second end of the card-type electronic device to said first guide surface.

20. A locking device as claimed in claim 19, wherein said locking section comprises:

an engaging portion that is pushed away from the card-type electronic device by the second end of the card-type electronic device when the first end of the card-type electronic device is being fitted to the connector; and a locking portion that locks the second end of the card-type electronic device when the first end of the card-type electronic device has been fitted to the connector, wherein said engaging portion has a sloping surface that guides the second end of the card-type electronic device, and wherein said locking portion has a surface opposed to the circuit board and a surface opposed to the connector.

21. A locking device as claimed in claim 20, wherein the sloping surface is substantially parallel to said second guide surface and is located closer to the circuit board than said second guide surface, and the surface opposed to the connector is flush with the first guide surface when the second end of the card-type electronic device is locked by said locking portion.

22. A locking device as claimed in claim 17, wherein said housing comprises at least one second positioning pin for positioning said housing with respect to the circuit board.

23. A locking device as claimed in claim 22, wherein said housing comprises a plurality of said second positioning pins, and said second positioning pins have respective shapes which are different from each other.

24. A connector device including the locking device as claimed in claim 22.

25. A locking device for holding a card-type electronic device when a first end of the card-type electronic device is fitted to a connector that is fixed to a surface of a circuit board, comprising:

a housing fixed to the surface of the circuit board;

a spring section which is disposed in said housing, for being fitted to the card-type electronic device so as to apply an urging force to the card-type electronic device;

a locking section provided on said spring section, for engaging with a second end of the card-type electronic device fitted to the connector so as to prevent the second end of the card-type electronic device from being lifted; and a guide section provided in said housing, for guiding a part of said spring section in a predetermined direction, wherein said locking section comprises:

an engaging portion that is pushed away from the card-type electronic device by the second end of the card-type electronic device when the first end of the card-type electronic device is being fitted to the connector; and a locking portion that locks the second end of the card-type electronic device when the first end of the card-type electronic device has been fitted to the connector, wherein said engaging portion has a sloping surface that guides the second end of the card-type electronic device, and wherein said locking portion has a surface opposed to the circuit board and a surface opposed to the connector.

* * * * *